US006127943A

United States Patent [19]

Tauchi et al.

[11] Patent Number: 6,127,943

[45] Date of Patent: Oct. 3, 2000

[54] AUDIBLE TRAFFIC SIGNAL FOR VISUALLY IMPAIRED PERSONS USING MULTIPLE SOUND OUTPUTS

[75] Inventors: Masaki Tauchi; Hajime Sawai; Jinro Takato, all of Okayama; Takashi Yoshiura, Yokohama; Shinichi Takahara, Yokohama; Toru Suzuki, Yokohama, all of Japan

[73] Assignee: Koito Industries, Ltd., Japan

[21] Appl. No.: 09/416,821

[22] Filed: Oct. 12, 1999

[30] Foreign Application Priority Data

Oct. 13, 1998 [JP] Japan ..... 10-290944

[51] Int. Cl.[7] ..... G08G 1/095

[52] U.S. Cl. ..... 340/944; 340/691.1; 340/692; 340/825.19; 367/116

[58] Field of Search ..... 340/944, 825.37, 340/925, 825.19, 906, 902, 907, 539, 691.1, 691.5, 692; 367/116; 704/271

[56] References Cited

U.S. PATENT DOCUMENTS

| | | | |
|---|---|---|---|
| 4,253,083 | 2/1981 | Imamura | 340/944 |
| 4,590,474 | 5/1986 | Patterson et al. | 340/944 |
| 4,812,746 | 3/1989 | Dallas, Jr. | 324/121 R |
| 4,914,435 | 4/1990 | Gould et al. | 340/144 |
| 4,951,045 | 8/1990 | Knapp et al. | 340/944 |
| 5,092,705 | 3/1992 | Raswant | 404/1 |
| 5,103,223 | 4/1992 | Humphrey | 340/944 |
| 5,241,307 | 8/1993 | Bidault et al. | 340/944 |
| 5,654,705 | 8/1997 | Houten et al. | 340/944 |

FOREIGN PATENT DOCUMENTS

| | | |
|---|---|---|
| 60-27079 | 6/1985 | Japan . |
| 7-95357 | 10/1995 | Japan . |

*Primary Examiner*—Jeffery A. Hofsass
*Assistant Examiner*—Phung Nguyen
*Attorney, Agent, or Firm*—Blakely Sokoloff Taylor & Zafman

[57] ABSTRACT

An audible traffic signal adding apparatus for visually impaired persons includes two speakers and a control section. The two speakers are disposed at two ends of a crosswalk. The control section navigates a visually impaired person crossing the crosswalk by alternately outputting different sounds as in "back and forth call" operation from the two speakers disposed at the two ends of the crosswalk to the visually impaired person for a period during which crossing is permitted.

13 Claims, 9 Drawing Sheets

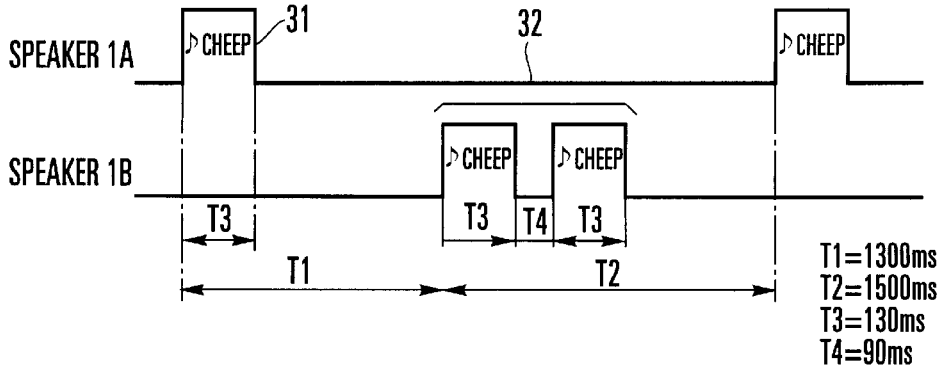
FIG. 3
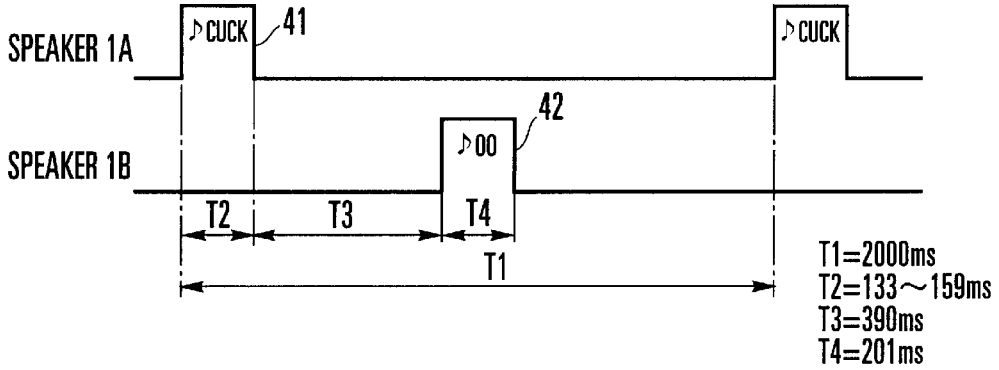
FIG. 4
| SPEAKER 1A | SPEAKER 1B | RELATION |
|---|---|---|
| ♪CHEEP | ♪CHEEP ♪CHEEP | REPETITION |
| ♪CUCK | ♪OO | MEANINGFUL SOUND |
| ♪CROSSING | ♪PERMITTED | |
| ♪(HIGH-PITCH SOUND) | ♪(LOW-PITCH SOUND) | FREQUENCY-MODULATED SOUND |
| ♪(SINE WAVE) | ♪(RECTANGULAR WAVE) | WAVEFORM-MODULATED SOUND |
| ♪POP-POP | ♪POP | MODULATION OF SOUND DURATION |
FIG. 5

| EXPERIMENT ITEM | ALTERNATE OUTPUT OF IDENTICAL SOUNDS (PRIOR ART) | ALTERNATE OUTPUT OF DIFFERENT SOUNDS (PRESENT INVENTION) |
|---|---|---|
| DISTANCE AT WITCH SOUND SOURCES CANNOT BE DISCRIMINATED | 4. 5m | – |
| OCCURRENCE RATE OF INABILITY TO SOUND SOURCES | 7/10 ( 70.0 % ) | 0/10 ( 0.0 % ) |

AUDIBLE TRAFFIC SIGNAL FOR VISUALLY IMPAIRED PERSONS USING MULTIPLE SOUND OUTPUTS

BACKGROUND OF THE INVENTION

The present invention relates to an audible traffic signal adding apparatus for visually impaired persons and, more particularly, to an audible traffic signal adding apparatus for visually impaired persons which navigates a visually impaired person crossing a crosswalk by outputting a predetermined sound for a period during which pedestrians are allowed to cross the crosswalk.

In general, analytical studies until now show that when a visually impaired person crosses a crosswalk, he/she performs tasks like those shown in FIG. 10.

FIG. 10 shows a series of tasks required to cross a crosswalk.

FIG. 10 shows a case without any audible traffic signal adding apparatus for visually impaired persons.

First of all, the visually impaired person confirms the existence of the crosswalk (step 101), and then confirms the entrance of the crosswalk (step 102) and the direction in which the person should cross (step 103).

The visually impaired person then estimates the length of the crosswalk (step 104), determines from the surrounding conditions that he/she can cross the crosswalk, and starts crossing the crosswalk (step 105).

The visually impaired person corrects his/her path while crossing the crosswalk (step 106). When the visually impaired person confirms that he/she has arrived at the opposite side of the crosswalk (step 107), he/she corrects his/her position, confirms a direction to go (step 108), and starts walking in the direction, thereby leaving the intersection (step 109).

On some crosswalks, audible traffic signal adding apparatuses for visually impaired persons are installed. Such an apparatus is designed to support a visually impaired person crossing a crosswalk by outputting predetermined sounds to the visually impaired person for a period synchronized with a blue signal for a pedestrian traffic signal i.e., a period during which crossing is permitted.

FIG. 11 shows a series of tasks required for a visually impaired person to cross a crosswalk with an audible traffic signal adding apparatus for visually impaired persons.

A description of the same steps as those in FIG. 10 will be omitted.

As preparations for crossing, steps 101 to 104 are executed as in the above case, and the visually impaired person starts crossing the crosswalk in accordance with a sound output indicating the permission of crossing and output from the audible traffic signal adding apparatus for visually impaired persons (step 105).

In step 106, when the visually impaired person is to correct his/her path while crossing the crosswalk, he/she repeatedly performs the following two tasks: discriminating the front and rear sound sources from the sound pressures (volumes) of predetermined sounds output from the two ends of the crosswalk or the output sequence of the alternately output sounds (step 111) and locating the target sound source positioned in the crossing direction, thereby determining his/her route (step 112).

Conventionally, such an audible traffic signal adding apparatus for visually impaired persons outputs sounds by the method shown in FIG. 12.

FIG. 12 shows the operation of the conventional audible traffic signal adding apparatus for visually impaired persons.

In this case, identical sounds, i.e., sounds 51 and 52 "♪ cu-ckoo", are alternately output from two speakers (sound output means) 50A and 50B opposed/disposed at two ends (start and end points) of a crosswalk.

In this conventional audible traffic signal adding apparatus for visually impaired persons, however, since identical sounds are alternately output from the two speakers opposed/disposed at the two ends of the crosswalk, the two sounds have no sound pressure difference near the middle of the crosswalk. This makes it difficult to discriminate the sounds.

FIG. 13 explains the relationship between the crossing distance and the sound pressure difference.

The sound pressures of sounds output from the speakers 50A and 50B decrease with an increase in crossing distance.

Near the middle of the crosswalk, therefore, the sound pressures of the two sounds become almost equal to each other, and the two sounds have no sound pressure difference.

As described above (see FIG. 11), the visually impaired person discriminates the target sound while crossing the crosswalk in accordance with the sound pressure difference between the two sounds.

More specifically, at the start of crossing, the visually impaired person determines that the sound source having a lower sound pressure is the sound source at the end point (i.e., the target sound source), and also memorizes the output sequence of this sound and the sound having a higher sound pressure and output from the sound source at the start point, which are alternately output.

During crossing, the visually impaired person discriminates the target sound source on the basis of the sound pressure difference between the two sounds and the memorized output sequence, and takes his/her route to the target sound source.

If, therefore, the visually impaired person is confused about the output sequence of sounds owing to an accident or ambient noise at the position where the sound pressure difference between the two sounds becomes almost zero, the visually impaired person has difficulty in locating the target sound source. This makes it difficult to smoothly cross the crosswalk.

SUMMARY OF THE INVENTION

The present invention has been made to solve the above problem, and has as its object to provide an audible traffic signal adding apparatus for visually impaired persons, which allows visually impaired persons to smoothly cross a crosswalk.

It is another object of the present invention to provide an audible traffic signal adding apparatus for visually impaired persons, which allows visually impaired persons to easily recognize the angular directions of sound sources and smoothly cross a crosswalk.

In order to achieve the above objects, according to the present invention, there is provided an audible traffic signal adding apparatus for visually impaired persons, comprising two sound output means disposed at two ends of a crosswalk, and control means for navigating a visually impaired person crossing the crosswalk by alternately outputting different sounds as in "back and forth call" operation from the two sound output means disposed at the two ends of the crosswalk to the visually impaired person for a period during which crossing is permitted.

BRIEF DESCRIPTION OF THE DRAWINGS

FIG. 3 is a timing chart showing the operation of the first embodiment;

FIG. 4 is a timing chart showing another operation of the first embodiment;

FIG. 5 is a view for explaining two sounds related to each other;

DESCRIPTION OF THE PREFERRED EMBODIMENTS

The present invention will be described next with reference to the accompanying drawings.

Figure 1:
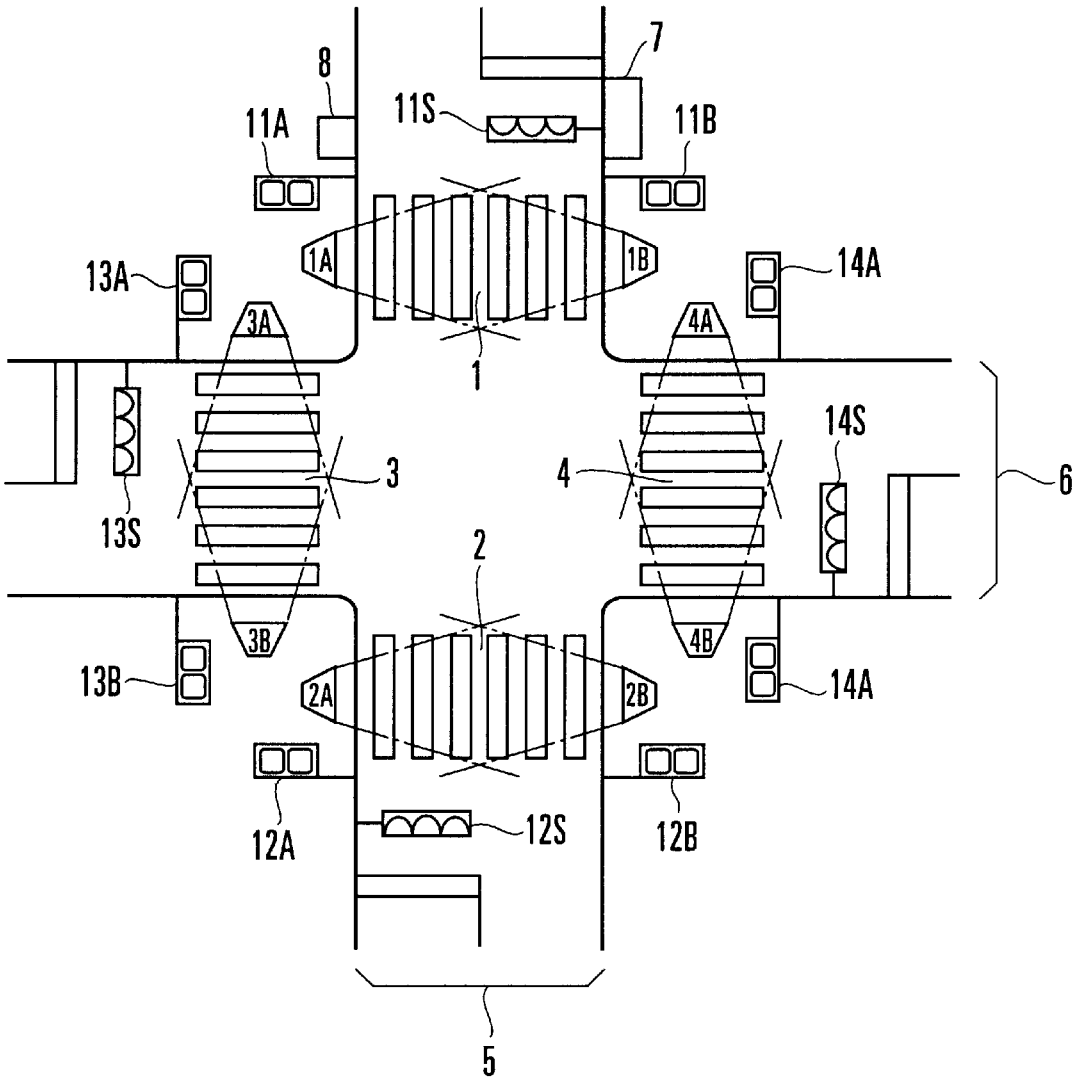
FIG. 1 is a schematic view showing an intersection where an audible traffic signal adding apparatus for visually impaired persons according to an embodiment of the present invention is installed.
Figure 2:
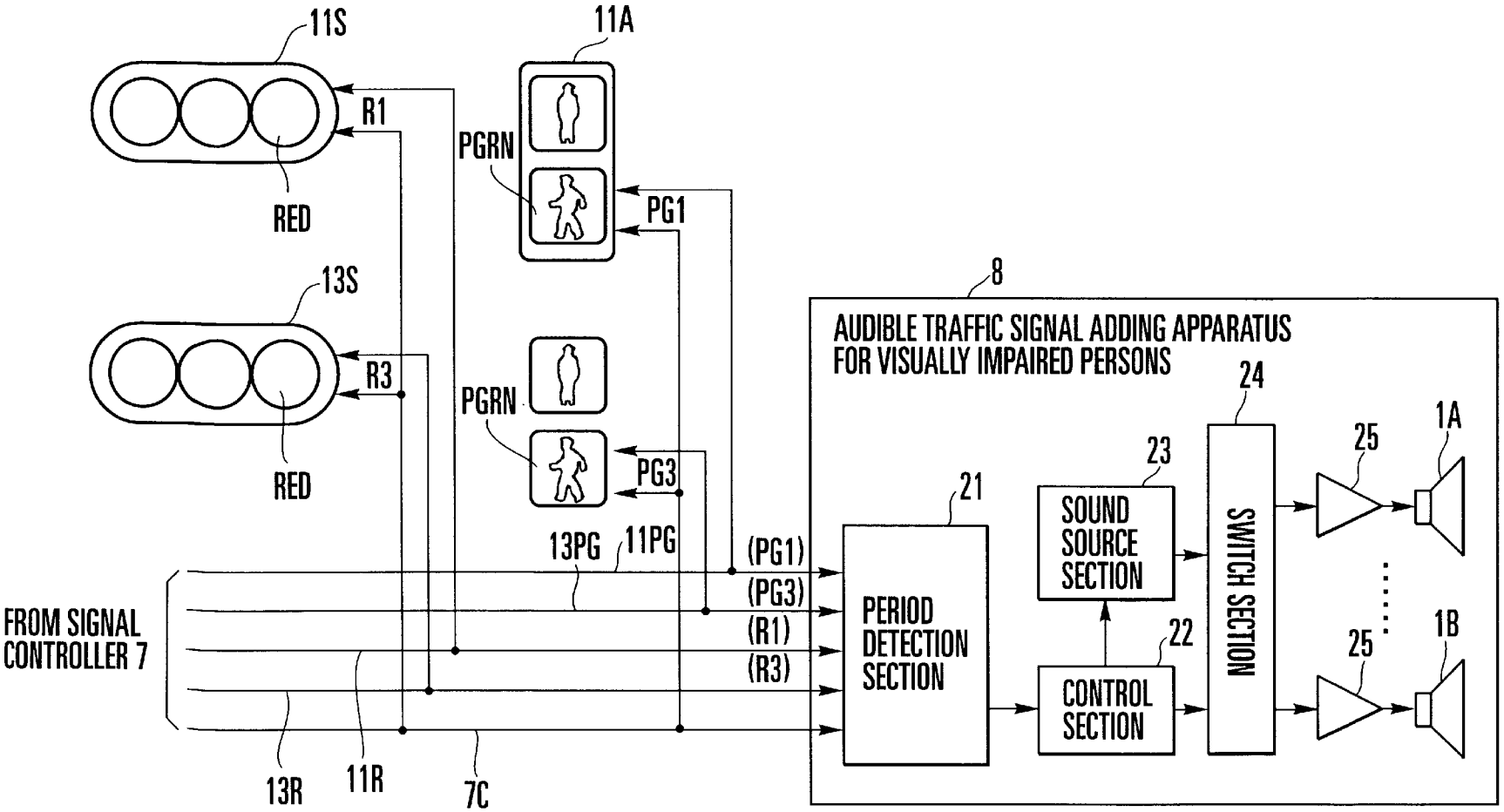
FIG. 2 is a block diagram of the audible traffic signal adding apparatus for visually impaired persons.

FIG. 1 schematically shows the intersection at which an audible traffic signal adding apparatus for visually impaired persons according to an embodiment of the present invention is installed. FIG. 2 shows the audible traffic signal adding apparatus for visually impaired persons.

Referring to FIG. 1, crosswalks 1 to 4 are provided at the intersection of roads 5 and 6. The crosswalks 1 and 2 are provided in a direction to cross the road 5, whereas the crosswalks 3 and 4 are provided in a direction to cross the road 6.

Pedestrian traffic signals 11A to 14A and 11B to 14B are installed on the sidewalks at the two ends (start and end points) of each of the crosswalks 1 to 4 so as to oppose each other.

Vehicle traffic signals 11S to 14S are installed on the driveways near the crosswalks 1 to 4.

These pedestrian traffic signals 11A to 14A and 11B to 14B and vehicle traffic signals 11S to 14S are controlled by various lighting signals from a signal controller 7.

An audible traffic signal adding apparatus for visually impaired persons (to be referred to as an adding apparatus hereinafter) 8 is installed near the crosswalk 1.

Pairs of speakers (sound output means) 1A to 4A and 1B to 4B are installed on the sidewalks at the two ends (start and end points) of each of the crosswalks 1 to 4 so as to oppose each other.

These speakers output predetermined sounds, under the control the adding apparatus 8, to visually impaired persons who cross the crosswalks for periods during which the pedestrians can cross the crosswalks.

In the first embodiment of the present invention, different sounds are alternately output from the two ends of an arbitrary crosswalk as in "back and forth call" operation.

For example, on the crosswalk 1, different sounds are output from the speakers 1A and 1B opposed/installed at the two ends of the crosswalk 1. The output timings of the speakers 1A and 1B are set such that different sounds are alternately output from the speakers as in "back and forth call" operation.

Referring to FIG. 2, green signal lights PGRN indicating permission of crossing and mounted on the pedestrian traffic signal 11A (ditto for the pedestrian traffic signals 11B, 12A, and 12B) and pedestrian traffic signal 13A (ditto for the pedestrian traffic signals 13B, 14A, and 14B) are turned on and blinked by green signals PG1 and PG3 output from the signal controller 7 through cables 11PG-7C and 13PG-7C. Reference numeral 7C denotes a return cable (common cable). A description of red signals will be omitted.

Red signal lights RED indicating inhibition of crossing and mounted on the vehicle traffic signal 11S (ditto for the vehicle traffic signal 12S) and vehicle traffic signal 13S (ditto for the vehicle traffic signal 14S) are turned on by red signals R1 and R3 output from the signal controller 7 through cables 11R-7C and 13R-7C. A description of green and yellow signals will be omitted.

The adding apparatus 8 has a period detection section 21 for detecting the crossing period of each crosswalk (during which pedestrians can cross). The period detection section 21 detects the crossing period of each crosswalk on the basis of the AND output of a pedestrian green signal PG for each crosswalk described above and a vehicle red signal R for a driveway crossing the crosswalk.

For example, the crossing period of the crosswalk 1 is detected on the basis of the AND output of the ON period (other than blinking and OFF periods) of the pedestrian green signal PG1 and the ON period of the vehicle red signal R1, and predetermined sounds are output from the speakers 1A and 1B within the detected period.

The adding apparatus 8 includes a sound source section 23 storing a plurality of sound signals, switch section 24 for switching/connecting the sound signals output from the sound source section 23 to a predetermined pair of speakers 1A to 4A and 1B to 4B through amplifiers 25, and control section 22 for causing a predetermined pair of speakers 1A to 4A and 1B to 4B to alternately output different sounds as in "back and forth call" operation by controlling the sound source section 23 and switch section 24 in accordance with the detection output from the period detection section 21.

In this embodiment, the adding apparatus 8 centrally controls the speakers installed on all the crosswalks.

However, an adding apparatus may be installed for each crosswalk to control the corresponding speakers.

For example, an adding apparatus may be designed such that a sound source is provided for each speaker, and the control section 22 performs only ON/OFF control on the output of the sound source.

The operation of the first embodiment will be described next by taking the crosswalk 1 as an example with reference to FIGS. 3 and 4.

FIGS. 3 and 4 show the operation of the first embodiment.

FIG. 3 shows a case wherein two different sounds are used for "back and forth call" operation with one sound being generated by repetition of the other sound.

In this case, the speaker 1A outputs a sound "♪cheep" first, and the speaker 1B then outputs a sound 32 "♪cheep" "♪cheep".

The sound 32 is made up of two sounds 31 (for example, duration T3=130 ms) that are repeatedly output at short intervals (e.g., interval T4=90 ms).

More specifically, the sound 32 is output a predetermined interval (e.g., interval T1=1300 ms>T3) after the start of output of the sound 31, and the sound 31 is output a predetermined interval (e.g., interval T2=1500 ms>T3+T4+T3) after the start of output of the sound 32. This output operation is repeated in predetermined cycles (T1+T2).

FIG. 4 shows a case wherein two sounds that acquire one meaning are used for "back and forth call" operation.

In this case, the speaker 1A outputs a sound 41 "♪cuck" first, and the speaker 1B then outputs a sound 42 "♪oo".

The two sounds 41 and 42 make the meaningful sound "♪cu-ckoo".

More specifically, the sound 42 (e.g., duration T4=201 ms) is output a predetermined interval (e.g., interval T3=390 ms) after the end of output of the sound 41 (e.g., duration T2=133 to 159 ms). This output operation is repeated in predetermined cycles (e.g., T1=2000 ms).

In this manner, since different sounds are alternately output, as in "back and forth call" operation, from the speakers 1A and 1B opposed/installed at the two ends of the crosswalk 1, the visually impaired person can easily discriminate the respective sounds output from the sound sources installed at the start and end points of the crosswalk without depending on the sound pressure difference between the two sounds and the memory of the output sequence as long as he/she memorizes the types of sounds, unlike the prior art in which identical sounds are output from the two sound sources.

Even if, therefore, the visually impaired person is confused about the output sequence of sounds owing to an accident or ambient noise at a position where the sound pressure difference between the two sounds becomes almost zero, he/she can accurately discriminate the target sound source and hence can smoothly cross the crosswalk.

If two sounds related to each other or two sounds one of which reminds pedestrians of the other sound are used as different sounds used in the first embodiment, the visually impaired person can easily memorize the target sounds from the correspondence between the sounds.

Even if the person temporarily fails to hear one of the sounds due to an accident or ambient noise while crossing a crosswalk, he/she can recall one sound from the association between the two sounds by effectively using the other sound.

As shown in FIG. 5, as such two sounds related to each other, two sounds one of which is generated by repetition of the other sound, e.g., "♪cheep" and "♪cheep cheep" (FIG. 3) or "♪bow-wow" and "♪bow-wow bow-wow", can be used.

In addition, two sounds that make up a meaningful sound, e.g., "♪cuck" and "♪oo" of "♪cu-ckoo" or "♪crossing" and "♪permitted", can be used.

Furthermore, as two sounds related to each other, two sounds one of which is generated by modulating the other sound can be used.

In this case, as two sounds obtained by using frequency modulation as a modulation method, for example, "♪ (high-pitched sound)" and "♪ (low-pitched sound)" having the same tone but having different frequencies may be used.

As two sounds obtained by using waveform modulation, for example, "♪ (sine wave)" and "♪ (rectangular wave)" having the same frequency but having different tones can be used.

As two sounds obtained by using volume envelope modulation, for example, "♪pih" and "♪peep" having the same frequency but having different durations can be used.

In this case, two sounds that can be recognized as two sounds having different attenuation characteristics of volume envelopes and exhibiting different rise characteristics regardless of the attenuation characteristics may be used.

Furthermore, two sounds that are related to each other and obtained by properly modulating frequency envelopes instead of volume envelopes may be used.

These two sounds are preferably output at the same output level. This makes it easy for the visually impaired person to recognize his/her position on a crosswalk on the basis of the sound pressure difference between the two sounds.

Note, however, the volumes of sounds heard by visually impaired persons may vary depending on the types of sounds. For this reason, the output levels of the two sounds may be adjusted such that the visually impaired persons hear them with the same volume almost in the middle of the crosswalk.

To confirm such effects of the first embodiment, the present inventors have conducted experiments to compare the first embodiment with the conventional scheme.

Figures 6A, 6B:
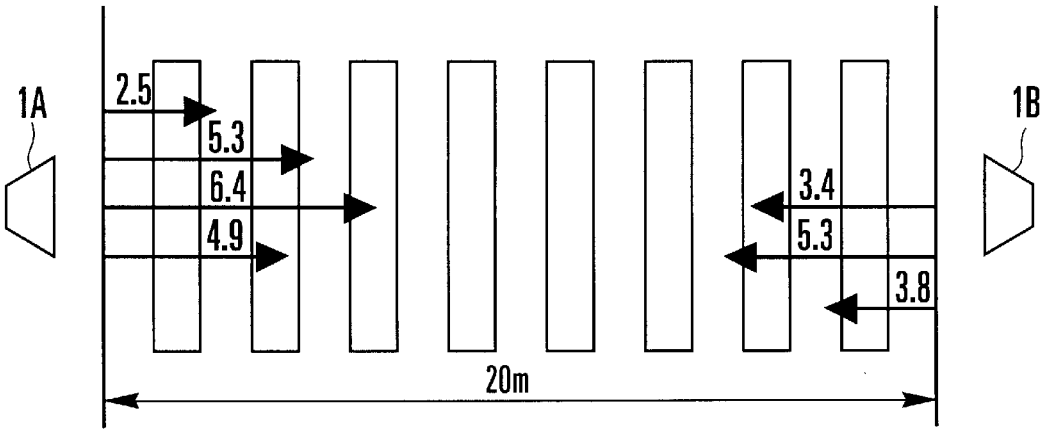
FIG. 6A is a view showing the experimental result obtained by the conventional scheme.
FIG. 6B is a view showing the experimental result obtained by the scheme of the present invention.

FIG. 6A shows the experimental result obtained by the conventional scheme. FIG. 6B shows the experimental result obtained by the scheme of the present invention.

In each experiment, a plurality of blindfolded subjects crossed a crosswalk having a length of 20 m from the start point to the end point, and the number of subjects who were confused about the direction of a target sound and felt impossible to discriminate sounds during crossing and the first positions (distances from the start point) where the subjects felt impossible to discriminate the sounds were measured.

In the experiment using the conventional scheme, the "back and forth" call scheme using identical sound sources.

In the experiment using the scheme of the present invention, the audible traffic signal adding apparatus for visually impaired persons was operated in accordance with the timing chart of FIG. 3.

As shown in FIG. 6A, in the experiment using the conventional scheme, subjects could not discriminate the target sound source while crossing the crosswalk in seven trials out of 10 trials.

In contrast to this, in the experiment using the scheme of the present invention, all subjects could discriminate the target sound source while crossing the crosswalk, and all the subjects could smoothly cross the crosswalk without having any feelings of anxiety.

As shown in FIG. 6B, the distance from the first point where each subject could not discriminate the sound sources while crossing the crosswalk, and more specifically, the distance from the start end from which each subject started crossing the crosswalk, was measured.

All these distances were measured in the experiment using the conventional scheme, and the average of the measured values was 4.5 m.

According to the conventional scheme, therefore, about 70% of the subjects felt impossible to discriminate the target source at least once while crossing the crosswalk, and these subjects felt impossible to discriminate the target sound source for the first time at the position corresponding to 22% of the length of the crosswalk. It is therefore obvious that the present invention is very effective.

Figure 7A:
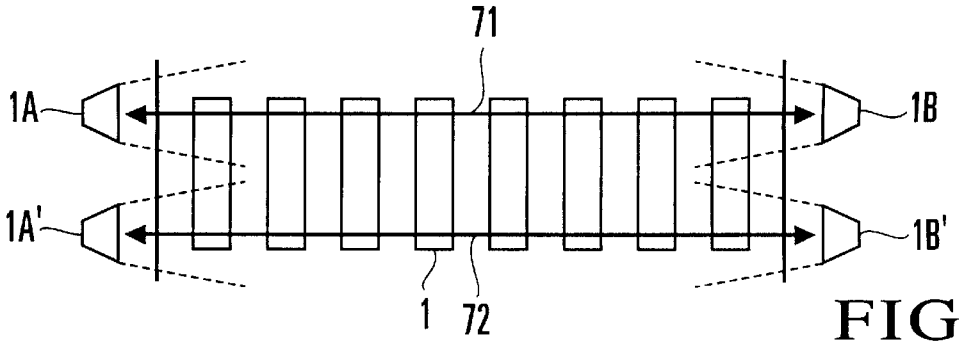
FIG. 7A is a view showing an example of how speakers are disposed in the second embodiment.

The second embodiment of the present invention will be described next with reference to FIGS. 7A to 7E. FIG. 7A shows the locations of speakers. FIGS. 7B to 7E are timing charts of sound outputs.

In the second embodiment, two speakers (sound output means) are installed at each end of a crosswalk, and the two speakers at each end of the crosswalk are spaced apart from each other.

These four speakers are arbitrarily paired to be controlled in units of pairs so as to output predetermined sounds from the two ends of the crosswalk to a visually impaired person crossing the crosswalk.

In this embodiment, speakers 1A and 1A' are installed at one end of a crosswalk 1 to be spaced apart from each other, and speakers 1B and 1B' are installed at the other end to be spaced apart from each other. These speakers are disposed almost parallel to each other through the crosswalk 1.

FIG. 7A shows a case wherein the speakers are controlled in units of pairs, i.e., a pair 71 of the speakers 1A and 1B almost facing each other, and a pair 72 of the speakers 1A' and 1B' almost facing each other. The opposing positions of the two speakers forming one pair are parallel to those of the two speakers forming the other pair.

Note that the distance between the speakers 1A and 1A' or between the speakers 1B and 1B' is preferably near to the width of the crosswalk, as shown in, for example, FIG. 7A. This makes it easy for visually impaired persons crossing the crosswalk to recognize the width of the crosswalk.

Figure 7B:
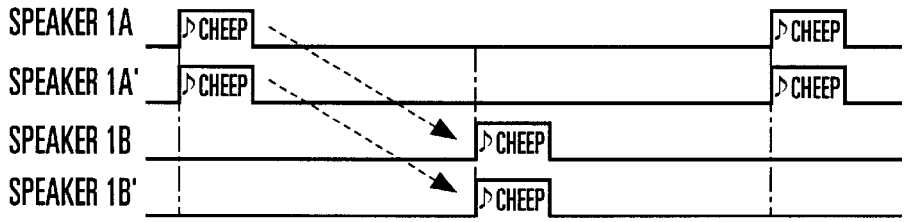
FIG. 7B is a timing chart showing an example of how sounds are output.

FIG. 7B shows a case wherein the speakers of the same pair performs "back and forth call" operation using identical sounds, and "back and forth call" operation of one pair is synchronized with that of the other pair.

More specifically, the speaker 1A of the pair 71 outputs "♪cheep" first, and the speaker 1B on the other end then outputs "♪cheep" after a lapse of a predetermined period.

The speaker 1A' of the pair 72 outputs "♪cheep" in synchronism with the speaker 1A of the pair 71, and the speaker 1B' on the other end then outputs "♪cheep" in synchronism with the speaker 1B of the pair 71.

With this operation, the sound sources become sound sources for outputting sounds that make the visually impaired persons have feelings of width instead of being point sound sources. This allows the visually impaired persons to easily recognize the angular direction of the sound sources and smoothly cross the crosswalk as compared with a case wherein point sound sources are used as in the prior art.

Figure 7C:
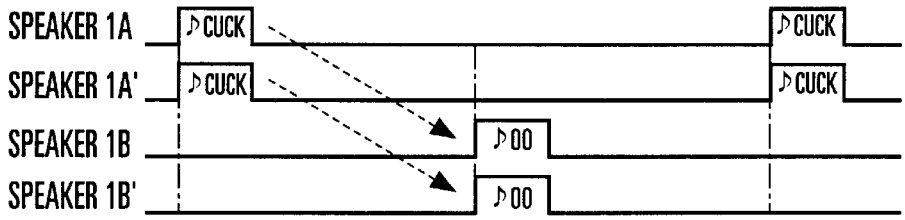
FIG. 7C is a timing chart showing another example of how sounds are output.

As shown in FIG. 7C, "back and forth call" operation may be performed by using different sounds output from the speakers of the same pair.

With this operation, the function/effect of the first embodiment can also be obtained in addition to the function/effect described with reference to FIG. 7B.

Figure 7D:
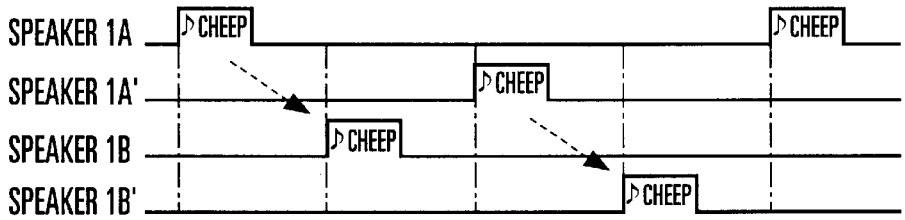
FIG. 7D is a timing chart showing still another example of how sounds are output.

FIG. 7D shows a case wherein the speakers of the same pair perform "back and forth call" operation using identical sounds, and "back and forth call" operations of the respective pairs are alternately performed.

More specifically, the speaker 1A of the pair 71 outputs "♪cheep" first, and the speaker 1B on the other end outputs "♪cheep" after a lapse of a predetermined period.

The speaker 1A' of the pair 72 outputs "♪cheep" first after a lapse of ½ cycle from the "back and forth call" operation of the pair 71, and the speaker 1B' on the other end then outputs "♪cheep".

When the "back and forth call" operations of the two pairs are alternately performed in this manner, the visually impaired person can easily recognize the widthwise direction of the crosswalk. This can reduce fluctuations in crossing path in the widthwise direction.

Figure 7E:
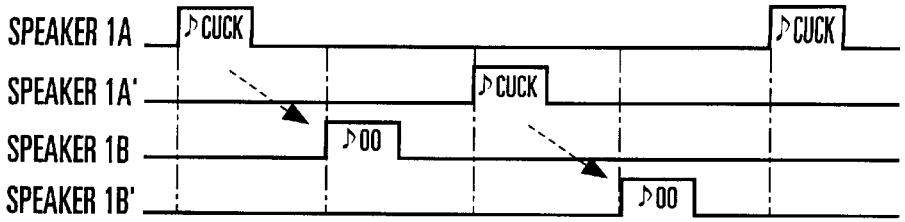
FIG. 7E is a timing chart showing still another example of how sounds are output.

As shown in FIG. 7E, "back and forth call" operation may be performed by using different sounds output from the speakers of the same pair.

With this operation, in addition to the function/effect described with reference to FIG. 7D, the function/effect of the first embodiment described above can be obtained.

In addition, in the pair 72, the speaker 1B' may output a sound first.

Figure 8:
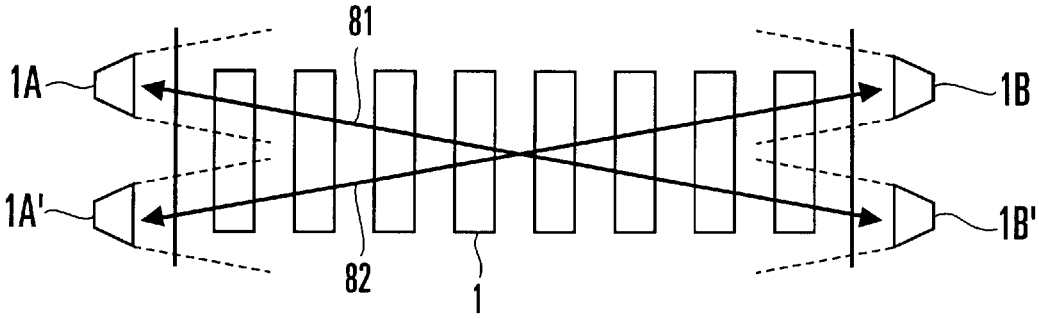
FIG. 8 is a view showing another example of how speakers are disposed in the second embodiment.

As another method of forming speaker pairs, the method shown in FIG. 8 can be provided.

FIG. 8 shows another example of the second embodiment. More specifically, FIG. 8 shows a case wherein the speakers 1A and 1A' are disposed at one end of the crosswalk 1, and the speakers 1B and 1B' are disposed at the other end of the crosswalk 1. Of these speakers, the speakers 1A and 1B' obliquely facing each other form a pair 81, and the speakers 1A' and 1B form a pair 82, thereby controlling the respective speakers.

In this case, the positions of the two speakers of each pair are diagonal to each other.

Note that the respective speakers can output sounds at timings similar those to those shown in the timing charts of FIGS. 7B to 7E. That is, the method of performing "back and forth call" operation using identical or different sounds from the speakers of the same pair, and synchronizing the "back and forth call" operations of the respective pairs with each other can be used.

In addition, the method of performing "back and forth call" operation using identical or different sounds from the speakers of the same pair, and alternately performing the "back and forth call" operations of the respective pairs can be used.

With this operation, as in the case shown in FIG. 7A, the sound sources become sound sources for outputting sounds that make the visually impaired persons have feelings of width instead of being point sound sources. This allows the visually impaired persons to easily recognize the angular direction of the sound sources and smoothly cross the crosswalk as compared with a case wherein point sound sources are used as in the prior art.

Furthermore, a speaker pair forming method of forming a pair from speakers juxtaposed at the same end of a crosswalk may be used instead of the method of forming a pair from speakers opposed/disposed on the two ends of the crosswalk.

Figure 9A:
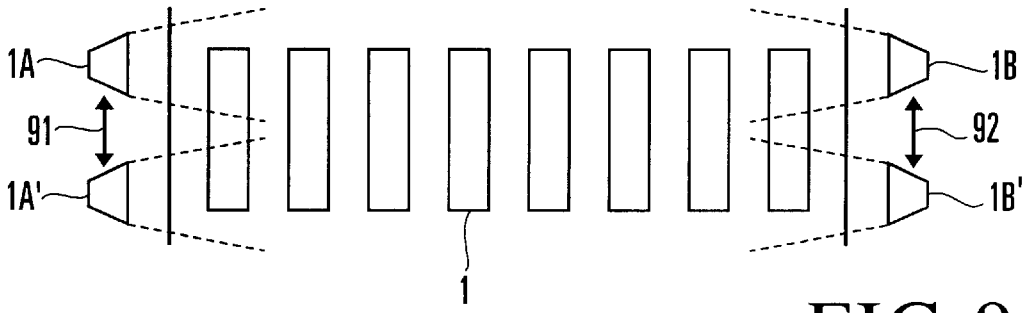
FIG. 9A is a view showing still another example of how the speakers are disposed in the second embodiment.
Figure 9B:
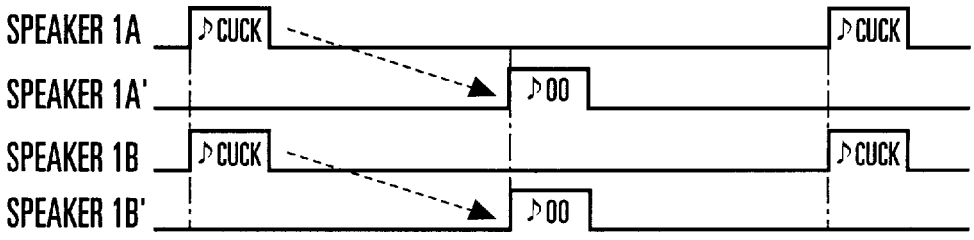
FIG. 9B is a timing chart showing an example of how sounds are output.
Figure 9C:
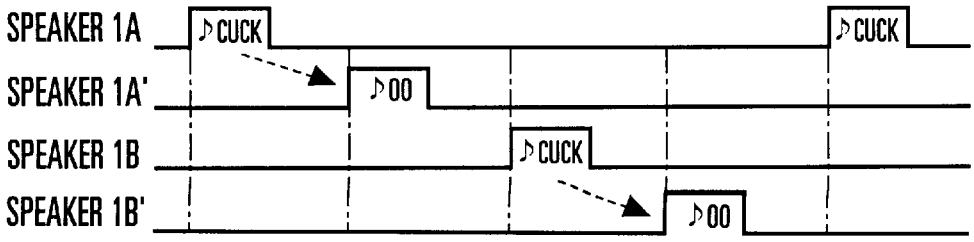
FIG. 9C is a timing chart showing another example of how sounds are output.
Figure 10:
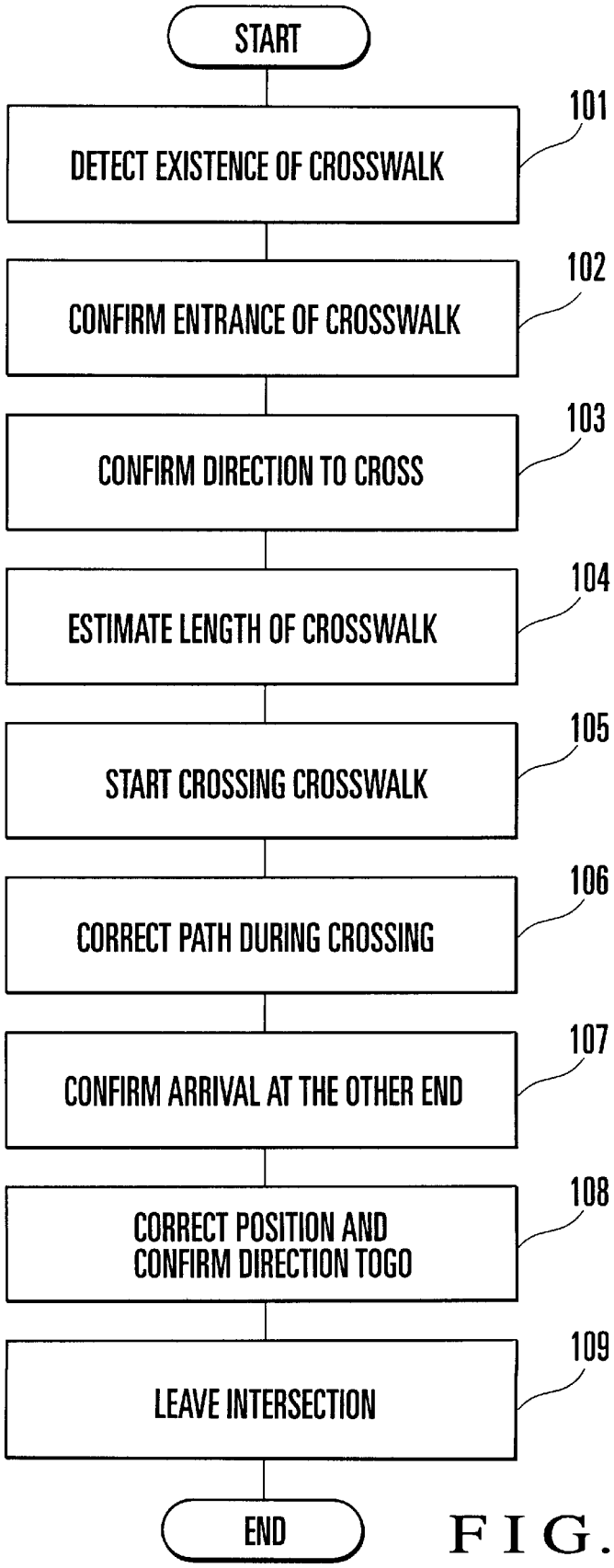
FIG. 10 is a schematic diagram showing a series of tasks required to cross a crosswalk.
Figure 11:
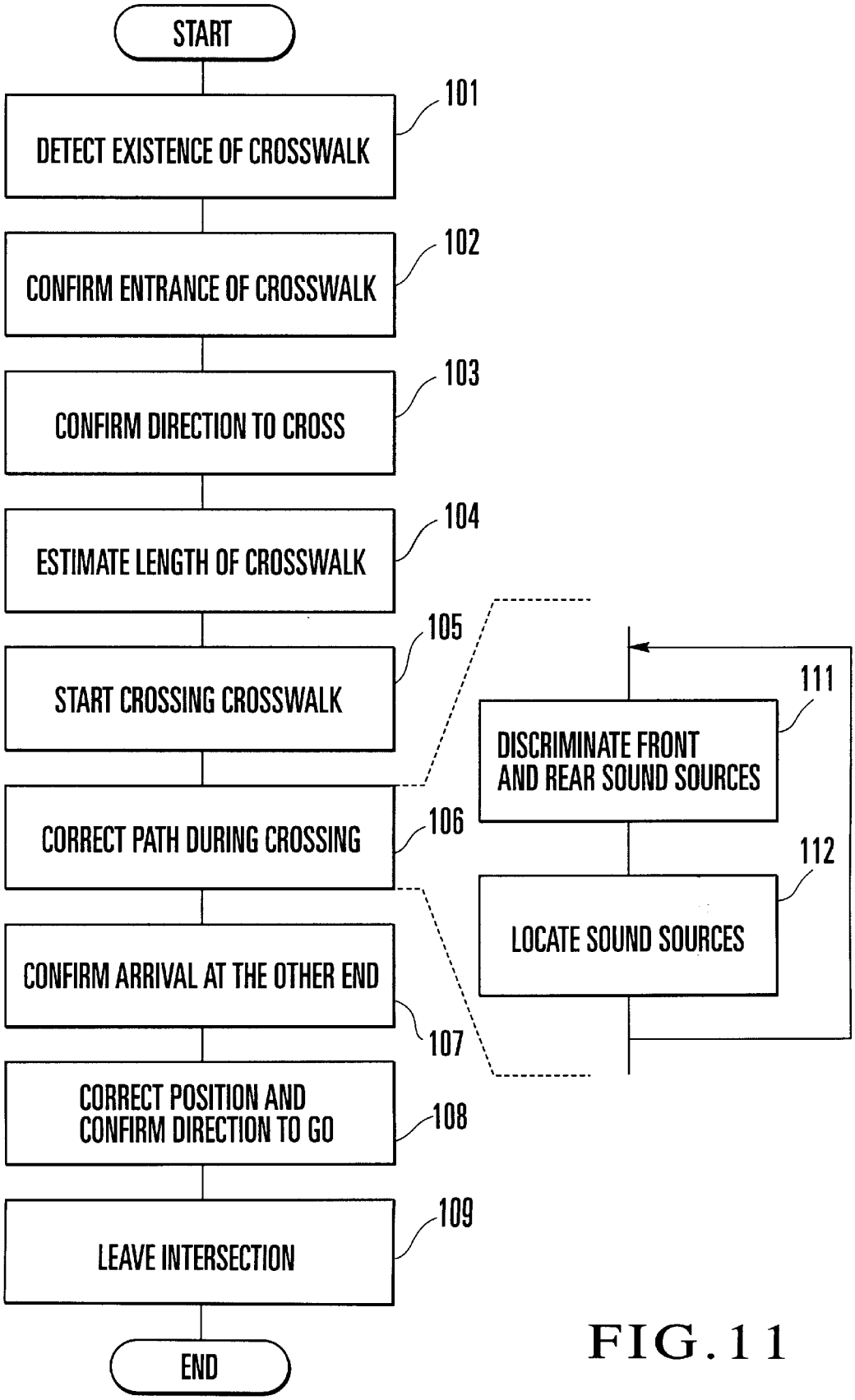
FIG. 11 is a schematic diagram showing a series of tasks required to cross a crosswalk with an audible traffic signal adding apparatus for visually impaired persons.
Figure 12:
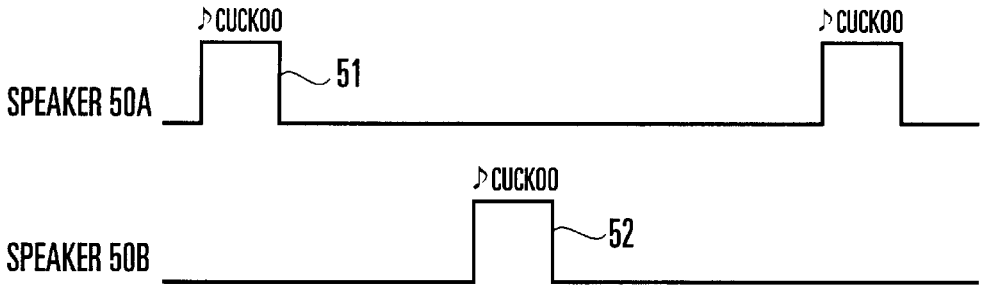
FIG. 12 is a timing chart showing the operation of a conventional audible traffic signal adding apparatus for visually impaired persons.
Figure 13:
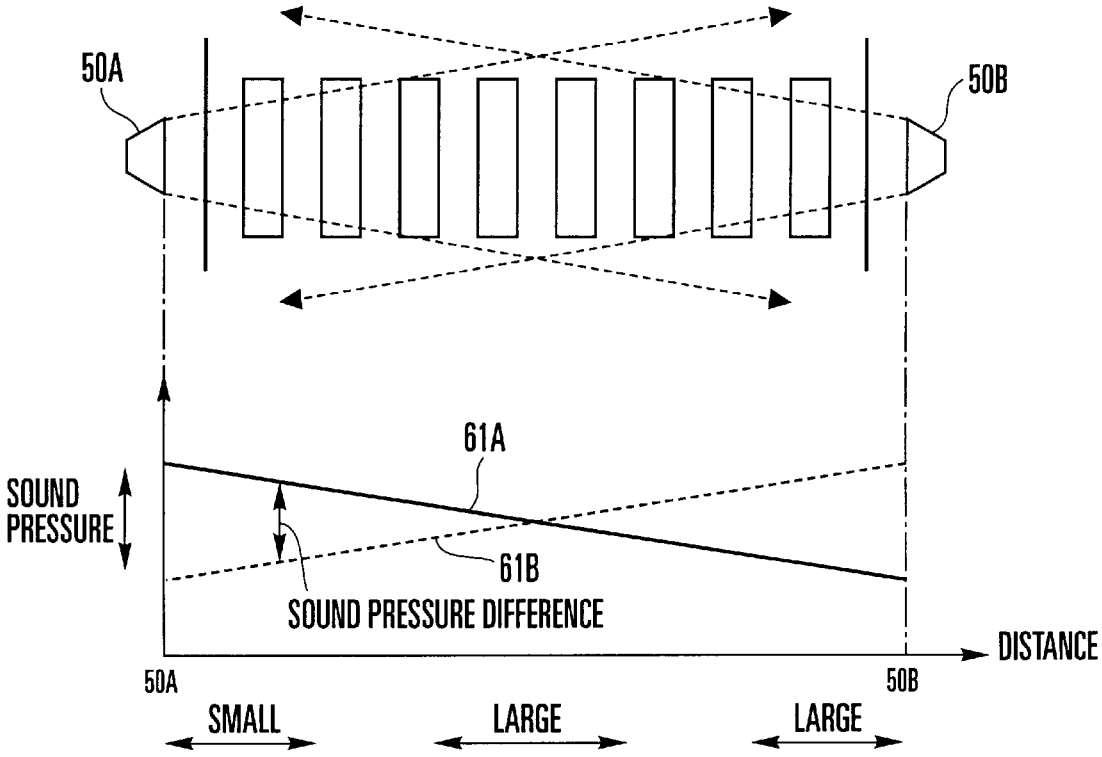
FIG. 13 is a view for explaining the relationship between the crossing distance and the sound pressure difference.

FIGS. 9A to 9C show other examples of the second embodiment. FIG. 9A shows the locations of the speakers. FIGS. 9B and 9C show the timings of sound outputs.

More specifically, FIG. 9A shows a case wherein the speakers 1A and 1A' are disposed at one end of the crosswalk 1, and the speakers 1B and 1B' are disposed at the other end. Of these speakers, the speakers 1A and 1A' form a pair 91, and the speakers 1B and 1B' form a pair 92, thus controlling the respective speakers.

FIG. 9B shows a case wherein "back and forth call" operation is performed using different sounds from the speakers of the same pair, and the "back and forth call" operations of the respective pairs are synchronized with each other.

More specifically, the speaker 1A of the pair 91 outputs "♪cuck" first, and the speaker 1A' juxtaposed with the speaker 1A then outputs "♪oo" after a lapse of a predetermined period.

The speaker 1B of the pair 92 outputs "♪cuck" in synchronism with the speaker 1A of the pair 91, and the speaker 1B' on the other end then outputs "♪oo" in synchronism with the speaker 1A' of the pair 91.

With this operation, the sound sources become sound sources for outputting sounds that make the visually impaired persons have feelings of width instead of being point sound sources. This allows the visually impaired persons to easily recognize the angular direction of the sound sources and smoothly cross the crosswalk as compared with a case wherein point sound sources are used as in the prior art.

In the case shown in FIG. 9B, "back and forth call" operation may be performed by using identical sounds from the speakers of the same pair.

FIG. 9C shows a case wherein "back and forth call" operation is performed using different sounds from the speakers of the same pair, and the "back and forth call" operations of the respective pairs are alternately performed.

More specifically, the speaker 1A of the pair 91 outputs "♪cuck" first, and the speaker 1A' juxtaposed with the speaker 1A then outputs "♪oo" after a lapse of a predetermined period.

The speaker 1B of the pair 92 outputs "♪cuck" first after a lapse of ½ cycle from the "back and forth call" operation of the pair 91, and the speaker 1B' juxtaposed with the speaker 1B' then outputs "♪oo" after a lapse of a predetermined period.

When the "back and forth call" operations of the two pairs are alternately performed in this manner, the visually impaired person can easily recognize the widthwise direction of the crosswalk. This can reduce fluctuations in crossing path in the widthwise direction.

Referring to FIG. 9C, "back and forth call" operation may be performed by using identical sounds from the speakers of the same pair.

In addition, the speaker 1B' of the pair 92 may output a sound first.

As has been described above, according to the present invention, two sound output means disposed at the two ends of a crosswalk are used to alternately output different sounds, as in "back and forth call" operation, from the two ends of the crosswalk to the visually impaired person crossing the crosswalk. This allows the visually impaired person to accurately discriminate the sound sources and can improve the safety and comfort of visually impaired persons in crossing the crosswalk, thereby allowing them to smoothly cross the crosswalk.

In addition, four sound output means disposed in pairs on the two ends of a crosswalk are arbitrarily formed into two pairs, and sound output operation is controlled in units of pairs to output predetermined sounds from the two ends of the crosswalk to the visually impaired person crossing the crosswalk. With this operation, the sound sources become sound sources for outputting sounds that make the visually impaired persons have feelings of width instead of being point sound sources. This allows the visually impaired persons to easily recognize the angular direction of the sound sources and smoothly cross the crosswalk as compared with a case wherein point sound sources are used as in the prior art.

What is claimed is:

1. An audible traffic signal adding apparatus for visually impaired persons, comprising:

two sound output means disposed at two ends of a crosswalk; and control means for navigating a visually impaired person crossing the crosswalk by alternately outputting different sounds in a back and forth call operation from said two sound output means disposed at the two ends of the crosswalk to the visually impaired person for a period during which crossing is permitted.

2. An audible traffic signal adding apparatus for visually impaired persons, comprising:

two pairs, each made up of arbitrary two of four sound output means disposed in pairs at two ends of a crosswalk, with said sound output means at the same end of the crosswalk being spaced apart from each other; and control means for controlling said sound output means in units of pairs to navigate a visually impaired person crossing the crosswalk by outputting predetermined sounds from said sound output means of said respective pairs disposed at the two ends of the crosswalk to the visually impaired person for a period during which crossing is permitted.

3. An apparatus according to claim 2, wherein said control means alternately outputs identical sounds in a back and forth call operation from said two sound output means of each pair.

4. An apparatus according to claim 2, wherein said control means alternately outputs different sounds in a back and forth call operation from said two sound output means of each pair.

5. An apparatus according to claim 1, wherein as the different sounds, sounds related to each other are used.

6. An apparatus according to claim 5, wherein as the sounds related to each other, a predetermined sound and a sound generated by repetition of the predetermined sound are used.

7. An apparatus according to claim 5, wherein as the sounds related to each other, two sounds that acquire one meaning are used.

8. An apparatus according to claim 5, wherein as the sounds related to each other, a predetermined sound and a sound generated by modulating the predetermined sound are used.

9. An apparatus according to claim 2, wherein each of said pairs is made up of two sound output means disposed at the two ends of the crosswalk, and opposing positions of said two sound output means forming each pair are parallel to those of another pair.

10. An apparatus according to claim 2, wherein each of said pairs is made up of two sound output means disposed at the two ends of the crosswalk, and opposing positions of said two sound output means forming each pair are diagonal to each other.

11. An apparatus according to claim 2, wherein each of said pairs is made up of said two sound output means disposed at the same end of the crosswalk.

12. An apparatus according to claim 2, wherein said control means synchronously performs back and forth call operations of said pairs.

13. An apparatus according to claim 2, wherein said control means alternately performs back and forth call operations of said pairs.

* * * * *